United States Patent [19]

Holmes et al.

[11] 3,931,663

[45] Jan. 13, 1976

[54] SPRINGLESS SELF-LATCHING HINGE HAVING A RESILIENT HINGE MEMBER

[75] Inventors: Frank A. Holmes, Buena Park; Benjamin H. Stansbury, Jr., Beverly Hills, both of Calif.

[73] Assignee: Jaybee Manufacturing Corporation, Los Angeles, Calif.

[22] Filed: Dec. 6, 1974

[21] Appl. No.: 530,192

Related U.S. Application Data

[63] Continuation of Ser. No. 296,938, Oct. 12, 1972, abandoned.

[52] U.S. Cl. ..... 16/142; 16/150; 16/180; 16/DIG. 13

[51] Int. Cl.[2] ..... E05D 11/08

[58] Field of Search ..... 16/150, 140, 141, DIG. 13, 16/180, 142, 139, 145, 184, 50, 85, DIG. 10, DIG.17; 220/315, 335

[56] References Cited

UNITED STATES PATENTS

| | | | |
|---|---|---|---|
| 2,083,140 | 6/1937 | Brantingson | 16/140 |
| 2,136,141 | 11/1938 | Loftin et al. | 16/184 |
| 2,636,759 | 4/1953 | Rueb | 16/140 |
| 3,475,783 | 11/1969 | Jorgensen | 16/128 R |
| 3,629,899 | 12/1971 | Deadrick | 16/180 |
| 3,822,440 | 7/1974 | Holmes et al. | 16/142 |
| 3,837,043 | 9/1974 | Coe | 16/180 |

*Primary Examiner*—Geo. V. Larkin
*Attorney, Agent, or Firm*—Flam & Flam

[57] ABSTRACT

In a springless self-latching hinge having a pair of hinge members pivotally connected by a hinge pin, one hinge member is formed of resilient material configured releasably to maintain the hinge closed. This resilient hinge member includes a spaced pair of hinge pin receiving knuckles extending from a base portion which may be slightly bowed toward the pin. The other hinge member has a hinge knuckle terminating at a bearing sleeve a portion of which incompletely encircles the pin to define a recess. A boss projects from the central base portion of the resilient hinge member to engage the bearing sleeve recess when the hinge is closed. As the hinge is opened, the bearing sleeve depresses the boss to place the central region under compression. Thus the hinge is held releasably closed until sufficient opening effort is exerted to rotate the hinge and thereby compress the resilient member. In an alternative embodiment, the resilient hinge member contains a central pin receiving knuckle and a pair of bosses which cooperate with a pair of recessed bearing sleeves on the other hinge leaf to perform the latching function.

12 Claims, 13 Drawing Figures

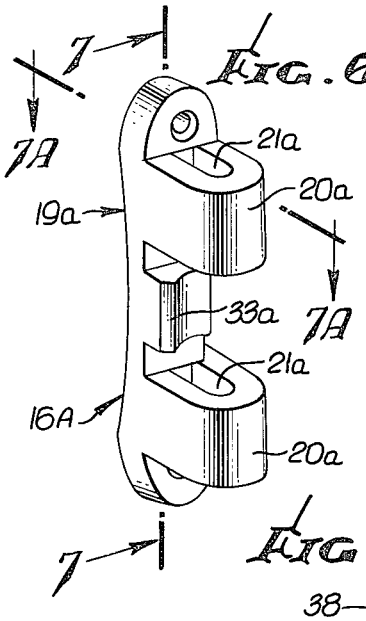
FIG. 6.
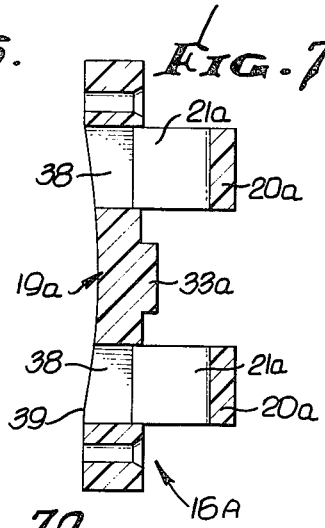
FIG. 7.
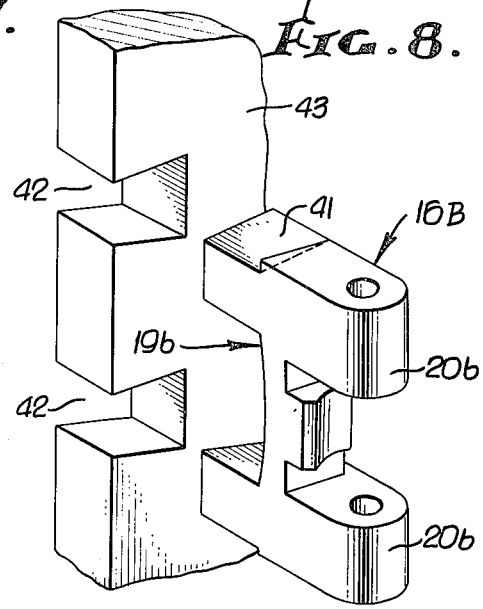
FIG. 8.
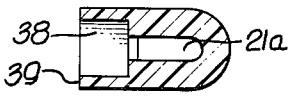
FIG. 7A.
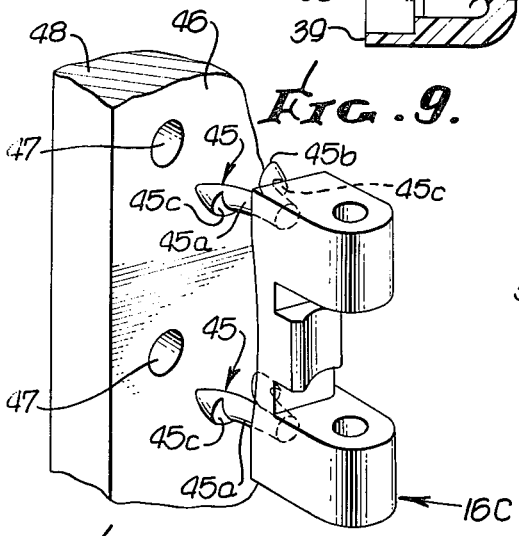
FIG. 9.
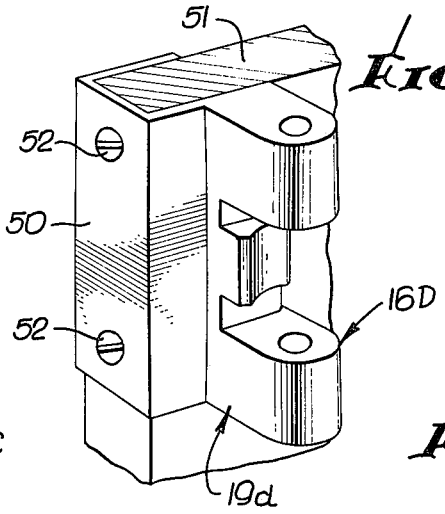
FIG. 10.
FIG. 11.
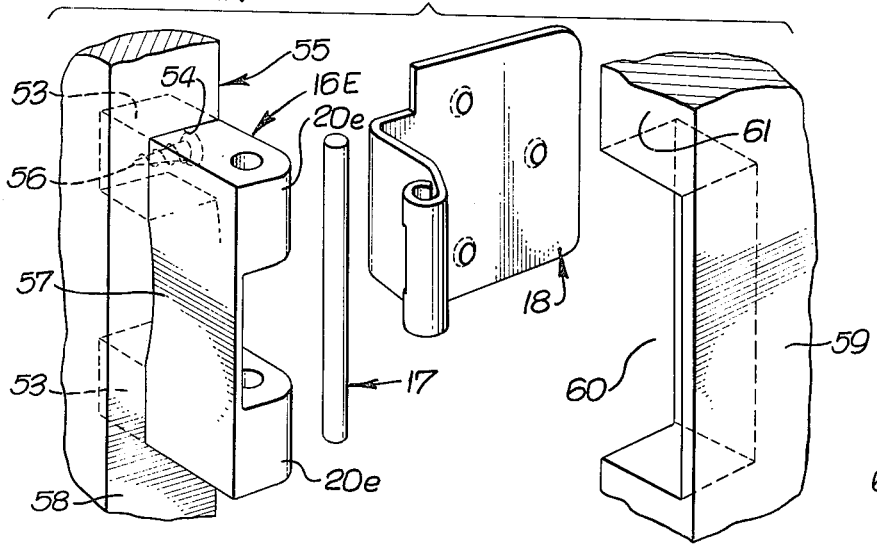
FIG. 12.
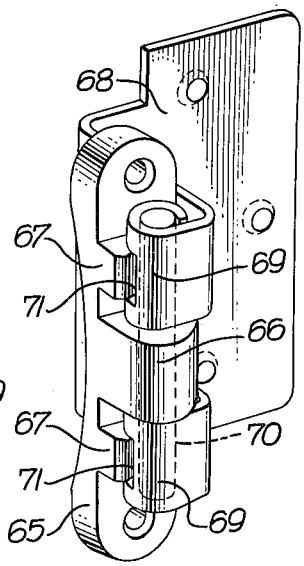

SPRINGLESS SELF-LATCHING HINGE HAVING A RESILIENT HINGE MEMBER

This application is a continuation of abandoned application Ser. No. 296,938 filed Oct. 12, 1972.

BACKGROUND OF THE INVENTION

1. Field of the Invention

The present invention relates to self-latching hinges, and particularly to such a hinge wherein the latching force is provided by the resilience of one of the hinge leaves.

2. Description of the Prior Art

Self-latching hinges have gained widespread acceptance in the building industry for installation of cabinet doors and the like. Such hinges include a force providing mechanism which maintains the cabinet door closed without the need for a separate latch. Use of self-latching hinges eliminates both the cost of the latch hardware and the even greater expense of latch installation.

In typical prior art self-latching hinges, a spring biased roller or wedge incorporated in one hinge leaf presses against a notched hinge pin bearing sleeve on the other leaf. As the hinge members are rotated toward the door-closing position, the roller or wedge is biased against the bearing sleeve notch to force the hinge closed. Some effort is required to open the hinge against the biasing force.

In most self-latching hinges of the type described, the roller or wedge biasing force is provided by a separate spring element mounted to one hinge leaf. Assembly is difficult, and both hinge leaves must be formed of relatively thick metal to withstand the substantial spring force. One object of the present invention is to provide a self-latching hinge requiring no separate spring element. A unitary hinge member functions both as a hinge leaf and as the force providing element for releasably maintaining the hinge closed. Another object is to provide a self-latching hinge wherein one hinge leaf is formed of a resilient material, typically a plastic which may be less costly than metal. This enables use of inexpensive molding techniques to fabricate the hinge leaf.

Yet shortcoming of prior art self-latching hinges concerned the manner of attachment to the frame or closure. Most commonly, one of the metal hinge leaves was fastened by screws to the cabinet or door frame. By providing a hinge wherein one leaf is formed of plastic, alternative means for attachment are available. Thus another object of the present invention is to provide a hinge construction wherein one leaf may be formed integral with a closure frame, or may be attached in other unique ways.

SUMMARY OF THE INVENTION

The foregoing objectives are achieved by providing a springless self-latching hinge having a pair of hinge members pivotally connected by a hinge pin. One unitary hinge pin is formed of resilient material, typically molded plastic, and includes a spaced pair of hinge pin receiving knuckles extending from a base portion which may be slightly bowed toward the pin. The other hinge leaf has a hinge knuckle terminating at a bearing sleeve a portion of which incompletely encircles the pin to define a recess. A boss projects from the base portion of the resilient hinge member to engage the bearing sleeve recess when the hinge is closed. As the hinge is opened, the bearing sleeve depresses the boss to compress or deform the central region of the resilient member. Thus the hinge is maintained releasably closed. Various means for mounting the hinge members also are disclosed. An alternative hinge embodiment uses two bosses on the resilient member cooperating with a spaced pair of recessed bearing sleeves on the other hinge leaf.

BRIEF DESCRIPTION OF THE DRAWINGS

A detailed description of the invention will be made with reference to the accompanying drawings wherein like numerals designate corresponding parts in the several figures. Unless otherwise indicated, the drawings are to scale.

FIG. 6 is a perspective view of a resilient hinge member configured for injection molding with minimal material usuage.

FIGS. 7 and 7A are transverse and lateral sectional views of the hinge of FIG. 6, as seen respectively along lines 7—7 and 7A—7A thereof.

FIG. 8 is a perspective view of a hinge member in accordance with the present invention and configured for dove-tail installation to a frame member.

FIG. 9 is a perspective view of another embodiment wherein the resilient hinge member is mounted using integral split dowel pegs.

FIG. 10 is a perspective view of a hinge member in accordance with the invention and including an integral mounting extension.

FIG. 11 is an exploded perspective view of a completely hidden hinge installation employing another embodiment of the invention.

FIG. 12 is a pictorial view of an alternative hinge embodiment wherein the resilient member has a single hinge pin receiving knuckle and a pair of bosses which cooperate with two recessed bearing sleeves on the other hinge member to perform the latching function.

DESCRIPTION OF THE PREFERRED EMBODIMENTS

Figure 1:
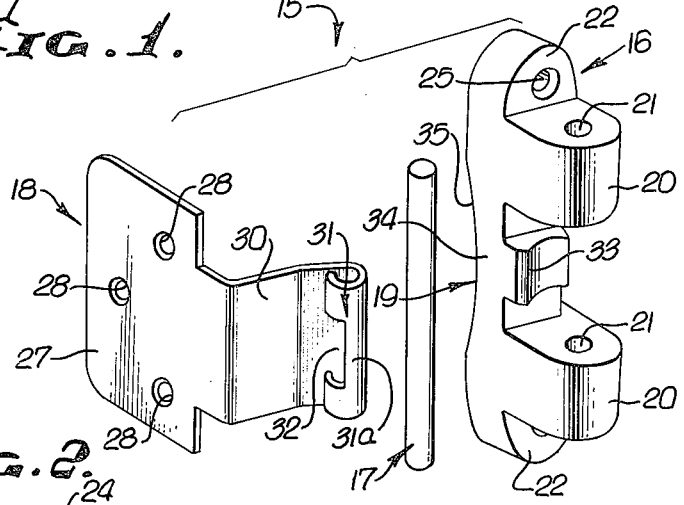
FIG. 1 is an exploded perspective view of a springless self-latching hinge in accordance with the present invention.
Figure 3:
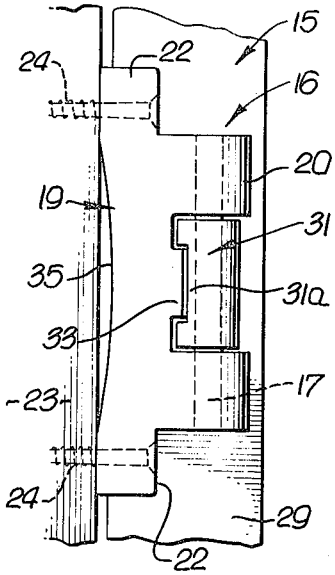
FIG. 3 is a side view of the hinge installation of FIG. 2, as seen along the line 3—3 thereof.
Figure 2:
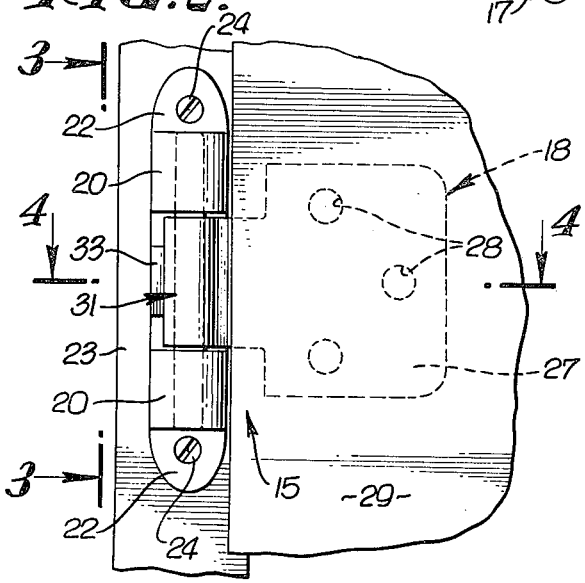
FIG. 2 is a front view of the hinge of FIG. 1, shown in a typical cabinet installation.

The following detailed description is of the best presently contemplated modes of carrying out the invention. This description is not to be taken in a limiting sense, but is made merely for the purpose of illustrating the general principles of the invention since the scope of the invention best is defined by the appended claims.

Structural and operational characteristics attributed to forms of the invention first described shall, also be attributed to forms later described, unless such characteristics are obviously inapplicable or unless specific exception is made.

Referring now to FIGS. 1 through 5, there is shown a first embodiment 15 of the inventive springless self-latching hinge. The hinge 15 has three parts, a first hinge member 16 formed of a resilient material such as molded plastic, a hinge pin 17 and a rigid hinge leaf 18 typically formed of metal. The resilient hinge member 16 includes a base portion 19 from which project a spaced pair of knuckles 20 provided with coaxial openings 21 for receiving the hinge pin 17. The ends 22 of the base portion 19 form flanges for mounting the hinge member 22 to a door or cabinet frame 23, as by screws 24 extending through holes 25 in the ends 22.

Figure 4:
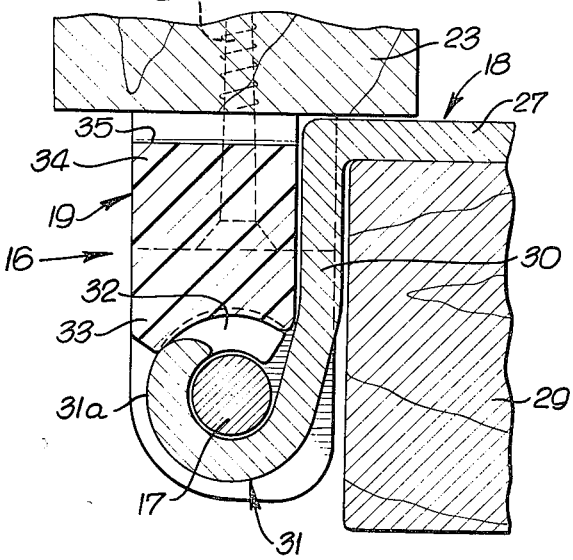
FIG. 4 is a transverse sectional view of the hinge of FIG. 2, as seen along the line 4—4 thereof; the hinge is closed.

The hinge leaf 18 includes a mounting plate 27 having holes 28 facilitating screw attachment to a door or closure 29. Extending generally perpendicularly from the plate 27 is a knuckle 30 the end of which is curled to form a bearing sleeve 31 engaging the pin 17. A portion of the bearing sleeve 31 incompletely encircles the pin 17 to define a bearing recess 32. A boss 33 extending from the central region 34 of the resilient hinge member base 19 engages the bearing recess 32 (as shown in FIG. 4) releasably to maintain the hinge 15 closed.

To open the hinge 15, the closure 29 and hinge leaf 18 are pivoted clockwise (as viewed in FIG. 4) about the hinge pin 17. The section 31a of the bearing sleeve 31 then depresses the boss 33 to compress the central base region 34 of the hinge member 16. Thus to open the closure 29, sufficient effort must be exerted to accomplish such compression.

Figure 5:
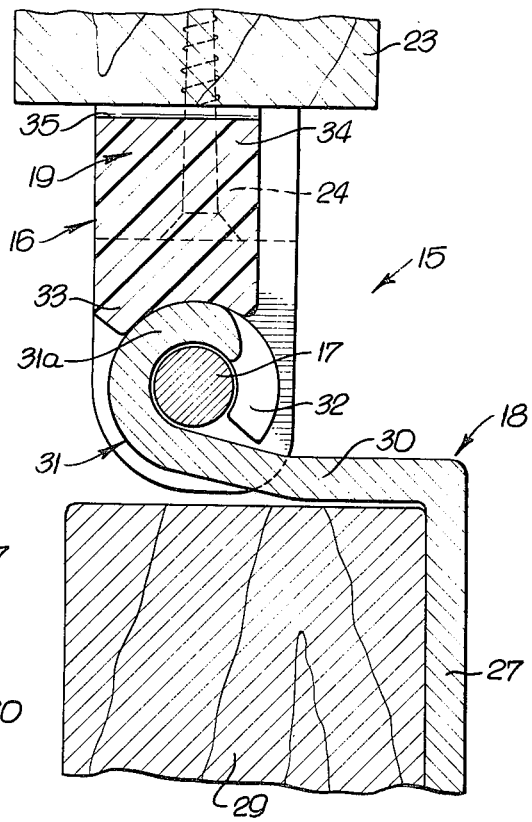
FIG. 5 is a transverse sectional view like FIG. 4, but with the hinge open.

The underside 35 of the base portion 19 may be recessed or arcuately curved toward the pin 17. When the hinge 15 is opened, the central region 34 is compressed toward the frame 23, thereby tending to flatten the arcuate surface 35, as indicated in FIG. 5. Thus the force provided by the resilient hinge member 16 may in part be due to the slight deformation of the region 34 away from the pin 17. This deformation is restricted principally to the region between the knuckles 20; the knuckles 20, end flanges 22 and screws 24 cooperate to maintain the hinge pin 17 at a fixed distance from the frame 23 as the hinge member 18 is opened.

With the hinge open (FIG. 5), the resilient force of the hinge member 16 acting through the boss 33 tends to maintain the closure 29 at any selected angular location. However, the force required to swing the closure 29 to a different position, or to close the hinge 15, is less than that required subsequently to open the hinge. Thus, with the hinge closed (FIG. 4), significant effort must be exerted via the closure 29 to open the hinge 15 and concomitantly to compress or deform the central region 34 of the resilient hinge member 16. In this manner, the self-latching feature is achieved.

An alternative configuration for the resilient hinge member is shown in FIGS. 6, 7 and 7A. There, the hinge member 16A is formed of a thermosetting plastic such as nylon. The member 16A includes hollow regions 38 beneath each knuckle 20 and opening to the bottom surface 39 thereof. The hinge pin 17 is received in openings 21a which extend from the recesses 38. With this arrangement, the member 16a can be formed completely in a single injection molding operation, the recesses 38 permitting unobstructed removal of the molding die. Material costs are minimized, since less plastic is used than in the embodiment of FIG. 1. The pin 17 remains in place against the upper portion of the hinge knuckles 20a by the resilient force of the base 19a acting through the boss 33a and the bearing sleeve 31.

In the embodiment of FIG. 6, the resilient hinge member 16B does not have mounting flanges 22. Instead, integral dove-tail legs 41 project from the base portion 19b in the opposite direction from the pin receiving knuckles 20b. The legs 41 mate with corresponding dove-tail grooves 42 in a frame member 43. An appropriate adhesive may be used to prevent the hinge member 16b from being pulled out of the grooves 42.

The resilient hinge member 16C of FIG. 9 is provided with integrally molded split dowel pegs 45. For mounting to a frame member 46, the semicylindrical dowel sections 45a, 45b are held together and inserted through frame holes 47. When inserted all the way through, the dowel sections spread apart so that the shoulders 45c engage the back surface 48 of the frame 46 to retain the hinge member 16C firmly in place. In an alternative embodiment, not shown, the resilient hinge member may be provided with cylindrical dowel pegs having just slightly smaller diameter than the holes 47. An adhesive then may be used to secure the dowels within the holes 47. Such an arrangement is particularly useful with a plastic frame. A solvent-type adhesive then may be used to secure the resilient plastic hinge member to the frame.

In the embodiment of FIG. 10, a mounting extension 50 is formed integral with the resilient hinge member 16D. The mounting member 50 has a generally U-shaped cross section and a length commensurate with that of the hinge base portion 19d. The extension 50 seats securely about the edge of a frame member 51, and may be retained in place by screws 52.

A concealed hinge installation is shown in FIG. 11. There, the resilient hinge member 16E is provided with rectangular legs 53 which extend into corresponding grooves 54 in a frame 55 and are secured therein by screws 56. An integral web 57 covers the region between the knuckles 20c flush with the rear surface 58 of the hinge member 16E. The hinge leaf 18 is secured to a closure 59 having a recess 60 which freely receives the portions of the resilient hinge member 16E projecting away from the frame 55. When assembled, the web 57 and the hinge surface 58 completely enclose the opening 60, flush with the end surface 61 of the closure 59. The hinge installation is completely hidden.

In an alternative embodiment (FIG. 12), the resilient hinge member 65 has one central pin-receiving hinge knuckle 66, with a pair of bosses 67 situated on opposite sides of the knuckle. The other hinge leaf 68 has a spaced pair of recessed bearing sleeves 69 which engage the pin 70 on either side of the central knuckle 66. The two bosses 67 cooperate with the recesses 71 in the spaced bearing sleeves 69 to perform the latching function.

Intending to claim all novel, useful and unobvious features shown or described, we make the following claims:

1. In a self-latching hinge structure for a cabinet:

a. a pair of hinge members connected together for angular movement about a hinge axis;

b. means determining a limited closed position of said hinge members;

c. one of said hinge members being made of relatively flexible, resilient molded plastic material;

d. means relatively rigidly securing spaced portions of said one hinge member to a relatively rigid cabinet to limit flexure between said spaced portions;

e. said hinge members having interacting parts developing stress in said one hinge member as a function of angular movement therebetween, said parts being positioned to maximize said stress just prior to arrival of said hinge members at said closed position;

f. said stress acting in a direction to impose a stress on said cabinet at said securing means.

2. The self-latching hinge structure as set forth in claim 1 in which said one hinge member has a normally bowed configuration between said spaced portions that assumes a flatter curvature upon being increasingly stressed by said interacting parts.

3. A self-latching hinge having a pair of hinge members pivotally connected by a hinge pin, characterized in that one hinge member has a hinge knuckle the end of which incompletely encircles said pin to define a bearing sleeve providing a latching recess, the other hinge member being formed of a resilient material and including a spaced pair of hinge pin receiving knuckles separated by a base portion having a boss extending toward said hinge pin to engage said recess when said hinge is closed, said bearing sleeve compressing said boss and base portion away from said pin when said hinge is opened, the resilience of said base thereby acting through said boss releasably to maintain said hinge closed; the region of said base portion being slightly arcuate to permit deflection of said region away from said pin as said base portion is compressed by said bearing sleeve; said knuckles, said base portion and said boss of other hinge member forming a one-piece integral structure.

4. A self-latching hinge according to claim 3 wherein said resilient hinge member includes one or more integral mounting members projecting therefrom.

5. A self-latching hinge according to claim 3 wherein the width of said boss is less than the distance between said pin receiving knuckles, and wherein said boss has a concave curvature generally conforming to the convex curvature of said bearing sleeve.

6. A self-latching hinge according to claim 3 wherein said one hinge member is rigid and formed of metal.

7. A self-latching hinge comprising:

1. a hinge pin,

2. a unitary first hinge member of resilient material having:

a. a base portion having a central region, b. a spaced pair of knuckles projecting from said base portion and provided with coaxial openings receiving said hinge pin, c. a force transmitting boss extending between said knuckles toward said pin,

3. a second, rigid hinge member having:

d. a mounting plate, and e. a hinge knuckle extending therefrom, f. the end of said hinge knuckle being curled to form a hinge pin bearing sleeve, at least a portion of said bearing sleeve incompletely encircling said pin to define a recess receiving said boss when said hinge is closed, said bearing sleeve depressing said boss to compress said base central region when said hinge is opened, the resilience of said first hinge member thereby releasably maintaining said hinge closed;

4. the said central region of said base portion of said first hinge member being bowed slightly toward said pin and said knuckles, said base portion and said boss of said first hinge member forming a one-piece integral structure.

8. A self-latching hinge according to claim 7 wherein said first hinge member includes integral mounting members projecting therefrom.

9. In a self-latching hinge structure:

a. a pair of hinge members;

b. one of said hinge members having a latch element made of resilient plastic material and bowed toward the other of said members;

c. the other of said hinge members having a relatively rigid latch element positioned to interact with said latch element of said one hinge member;

d. said latch elements having a configuration to provide a snap closing under the influence of the resilience of said one latch element;

e. a pair of fasteners connected to said one hinge member at spaced positions for confining the ends of said bowed latch element to provide a high spring constant as said bowed element flattens upon interaction with said other latch element whereby a high holding force is developed;

f. said bowed latch element assuming a flatter curvature upon being increasingly stressed by said relatively rigid latch element such that at the closed position of said hinge members a positive interaction and positive closure at said closed position is provided.

10. The self-latching hinge as set forth in claim 9 in which said one hinge member is substantially unstressed when the hinge is in open position.

11. The self-latching hinge structure as set forth in claim 9 in which said one hinge member is made of one-piece plastic unit with said pair of fasteners and adapted to be rigidly secured to a cabinet structure.

12. The self-latching hinge structure as set forth in claim 9 in which said bowed latch element is inwardly bowed at its under surface and is adapted to oppose and to flex toward a surface of said cabinet structure.

* * * * *